US007138588B2

(12) United States Patent
Soumi

(10) Patent No.: US 7,138,588 B2
(45) Date of Patent: Nov. 21, 2006

(54) OPERATING MEMBER

(75) Inventor: Mitsuo Soumi, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/354,837

(22) Filed: Feb. 16, 2006

(65) Prior Publication Data

US 2006/0196759 A1 Sep. 7, 2006

(30) Foreign Application Priority Data

Mar. 2, 2005 (JP) ..... 2005-057930

(51) Int. Cl.
*H01H 13/70* (2006.01)

(52) U.S. Cl. ..... 200/5 A; 200/341; 200/345

(58) Field of Classification Search ..... 200/5 A, 200/517, 512, 304, 305, 296, 341–345; 341/22; 345/168; 361/212, 220, 800, 816, 818, 490–496; 400/490–496
See application file for complete search history.

(56) References Cited

U.S. PATENT DOCUMENTS 3,999,025 A * 12/1976 Sims, Jr. ..... 200/516
4,638,151 A * 1/1987 Suwa ..... 200/345
4,671,688 A * 6/1987 Brashears ..... 200/304
6,023,033 A * 2/2000 Yagi et al. ..... 200/512
6,576,856 B1 * 6/2003 Masaru et al. ..... 200/512
6,664,486 B1 * 12/2003 Yoon et al. ..... 200/5 A

FOREIGN PATENT DOCUMENTS

JP 5-33428 U 4/1993

* cited by examiner

*Primary Examiner*—Michael A. Friedhofer
(74) *Attorney, Agent, or Firm*—Sughrue Mion, PLLC

(57) ABSTRACT

The operating member is constructed by supporting the button members with the thin sheet member without integrally constructing the button members, and therefore, the device can be downsized and slimmed. The key tops of the button members can be individually surface-treated before assembly, and therefore, a user can easily recognize the kinds of buttons at the time of operation, and an operation mistake can be prevented.

9 Claims, 12 Drawing Sheets

OPERATING MEMBER

BACKGROUND OF THE INVENTION

1. Field of the Invention

The present invention relates to an operating member, and particularly relates to an operating member which performs operation input by pressing a button.

2. Description of the Related Art

Conventionally, a panel switch with a plurality of buttons integrally constructed by a hinge portion to be mounted to a case having a button opening is proposed (for example, Japanese Utility Model Application Laid-open No. 5-33428).

However, since a plurality of buttons are integrally constructed in the panel switch as described above, in order to perform surface treatment (for example, plating, coating, polishing) individually for each button, it is necessary to apply masking to the other portions than the buttons for which the surface treatment is performed, and therefore, the treatment becomes troublesome. The buttons are sometimes placed at the positions separated from each other for design of the apparatuses and enhancement in operability. In this case, if each of the buttons is integrally constructed, there is the problem that the component such as the hinge portion increases in size and cost of the material increases. Further, the hinge portion requires enough strength to hold a plurality of buttons, and therefore, there is the problem that slimming is difficult.

SUMMARY OF THE INVENTION

The present invention is made in view of the above circumstances, and has an object to provide an operating member which makes it possible to work buttons individually, and makes it possible to reduce cost and thickness of components.

In order to achieve the above-described object, a first aspect of the present invention provides an operating member comprising: a button member having a key top and a key stem, an apparatus casing having a button opening from which the key top is exposed, a sheet member which is formed of a material having elasticity, has a key stem opening through which the key stem is penetrated, and holds the button member by pressing the button member to the button opening, and a base board on which a switch which constructs a transmission path of a signal when the key top is pressed and the switch is pressed by the key stem is placed.

The operating member according to the first aspect is constructed by supporting the button member with the thin sheet member without integrally constructing button members, and therefore, the device can be downsized and slimmed.

The operating member according to a second aspect is, in the first aspect, characterized in that the sheet member is formed of any one of polyester, polycarbonate and vinyl chloride. The second aspect limits the material of which the sheet member is formed.

The operating member according to a third aspect is, in the first or the second aspect, characterized in that at least one of coating, plating, polishing, and embossing is applied to a surface of the key top of the button member.

According to the operating member of the third aspect, surface treatment is individually applied to the key top of the button member, and therefore, the user easily recognizes the kind of button, and an operation mistake can be prevented.

The operating member according to a fourth aspect is, in any one of the first to the third aspects, characterized in that shapes of the key stem and the key stem opening are paired.

According to the operating member of the fourth aspect, the button member can be prevented from being mistakenly disposed at the time of assembly.

The operating member according to a fifth aspect is, in the first to the fourth aspects, characterized in that the sheet member has electrical conductivity, and when the sheet member is charged with static electricity, the sheet member discharges the static electricity to an outside.

According to the operating member of the fifth aspect, the static electricity which occurs by friction or the like at the time of pressing the button member can be discharged, and malfunction of the circuit of the apparatus can be prevented.

The operating member according to a sixth aspect is, in the first to the fifth aspects, characterized by further comprising a sheet support member which presses the sheet member against the apparatus casing.

According to the operating member of the sixth aspect, the sheet member is reliably pressed against the apparatus casing, and therefore, malfunction of the apparatus which is caused by the sheet member sagging to bring the button member into contact with the switch can be prevented.

The operating member according to a seventh aspect is, in the first to the sixth aspects, characterized in that the sheet support member is a bent part which is bent to a side of the base board on which the switch is placed by cutting a part of the sheet member, and that the bent part is biased to the apparatus casing side by the base board. The seventh aspect limits the sheet support member of the sixth aspect.

According to the present invention, the operating member is constructed by supporting the button members with the thin sheet member without integrally constructing the button members, and therefore, the device can be downsized and slimmed. According to the present invention, the key tops of the button members can be individually surface-treated before assembly, and therefore, a user can easily recognize the kinds of buttons at the time of operation, and an operation mistake can be prevented.

DETAILED DESCRIPTION OF THE PREFERRED EMBODIMENTS

Preferred embodiments of an operating member according to the present invention will be described with reference to the attached drawings. The operating member of the present invention can be applied to apparatuses having operation buttons such as digital cameras, key boards, and video/audio apparatuses.

Figure 1:
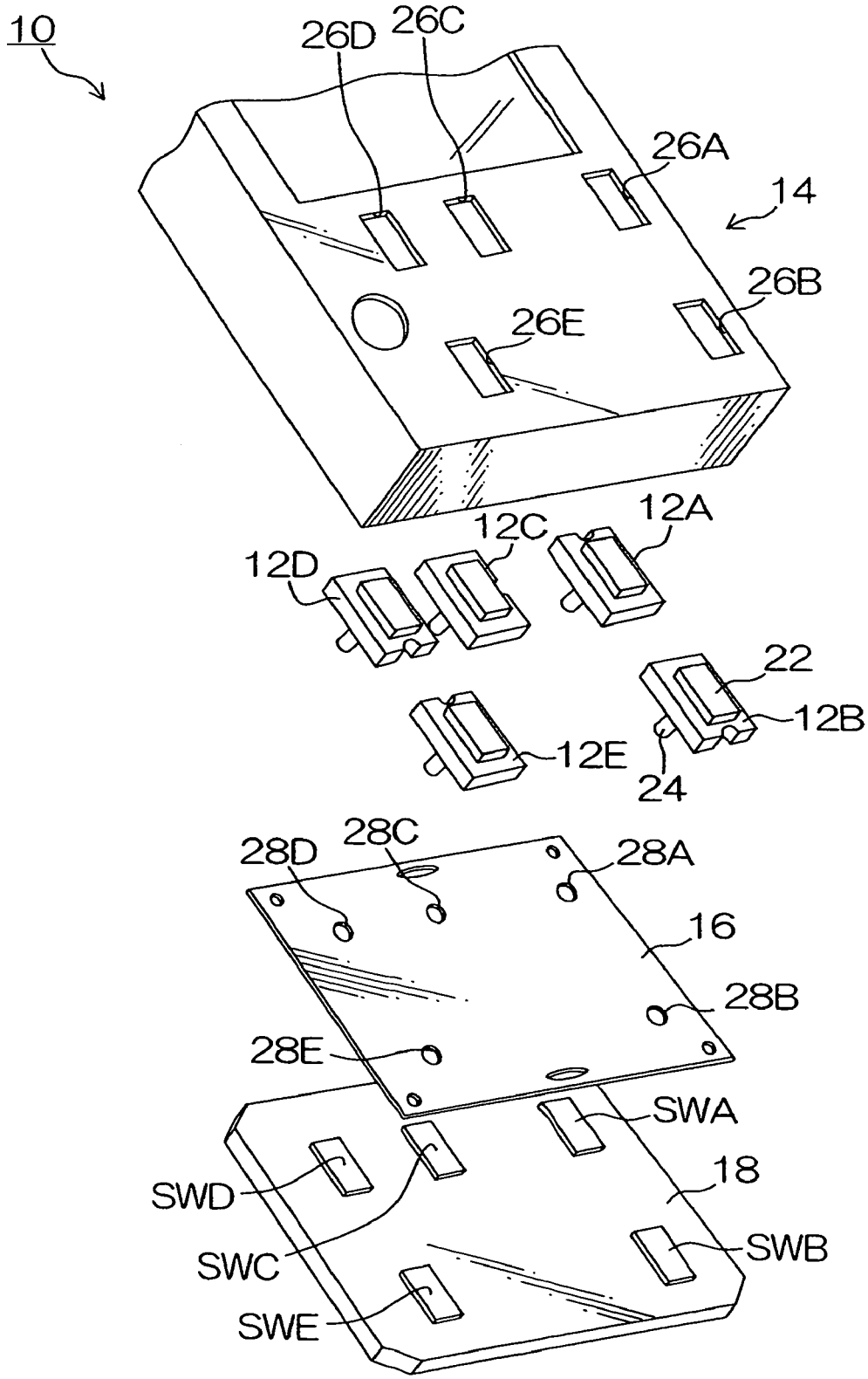
FIG. 1 is an exploded perspective view showing an operating member according to an embodiment of the present invention.

FIG. 1 is an exploded perspective view showing an operating member according to a first embodiment of the present invention. As shown in FIG. 1, an operating member 10 of the first embodiment includes button members 12A to 12E, an apparatus casing 14, a seat member 16 and a base board 18.

The button members 12A to 12E are formed of, for example, metal and a resin such as plastic, and are constructed by key tops 22 of which front surfaces are fitted into the apparatus casing 14 and exposed to an outside from button openings 26A to 26E, and key stems 24 which are fitted into the sheet member 16. Plating treatment is applied to the front surfaces of the key tops 22 of the button members 12A and 12B. Embossing treatment is applied to a top surface of the key top 22 of the button member 12C, and coating is applied to top surfaces of the key tops 22 of the button members 12D and 12E.

The apparatus casing 14 is an outer case of the apparatus to which the operation member 10 of the first embodiment is applied, and is provided with the button openings (26A to 26E respectively) in which the key tops 22 of the button members 12A to 12E are fitted.

The sheet member 16 is formed of a high polymer material such as polyester, polycarbonate or vinyl chloride, for example, and has elasticity. The thickness of the sheet member 16 is about 0.1 mm. The sheet member 16 is provided with key stem openings (28A to 28E respectively) at positions overlapping the button openings 26A to 26E when the sheet member 16 is overlaid on the apparatus casing 14.

On the base board 18, a circuit of the apparatus is formed, and switches (SWA to SWE respectively) are placed at positions which are overlaid on the button openings 26A to 26E and the key stem openings 28A to 28E when the base board 18 is overlaid on the apparatus casing 14 and the sheet member 16.

Note that in the following description, the button members 12A to 12E, the button openings 26A to 26E, the key stem openings 28A to 28E and the switches SWA to SWE are described by properly removing the subscripts A to E from them.

Figure 2:
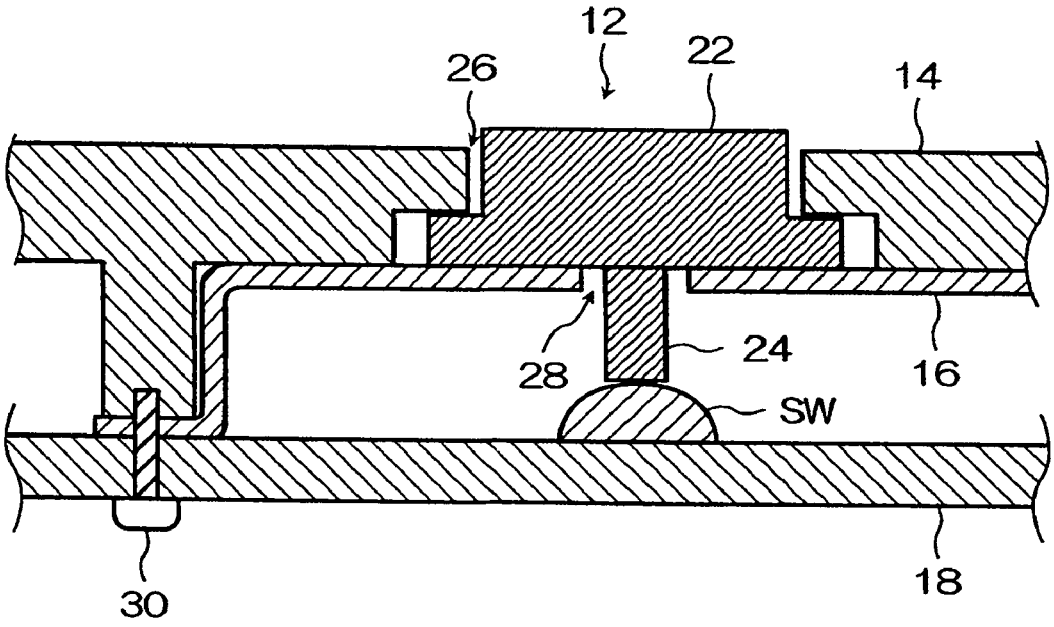
FIG. 2 is an enlarged sectional view of a part of an operating member 10.

FIG. 2 is an enlarged sectional view showing a part of the operating member 10. The key tops 22 of the button members 12 are respectively fitted into the button openings 26 of the apparatus casing 14, and the key stems 24 are respectively fitted into the key stem openings 28 of the sheet member 16. The sheet member 16 is bonded to an inner surface of the apparatus casing 14 by an adhesive, and is fixed to the apparatus casing 14 by a screw 30. Thereby, the button member 12 is sandwiched and fixed by the inside surface of the apparatus casing 14 and the sheet member 16.

Figure 3:
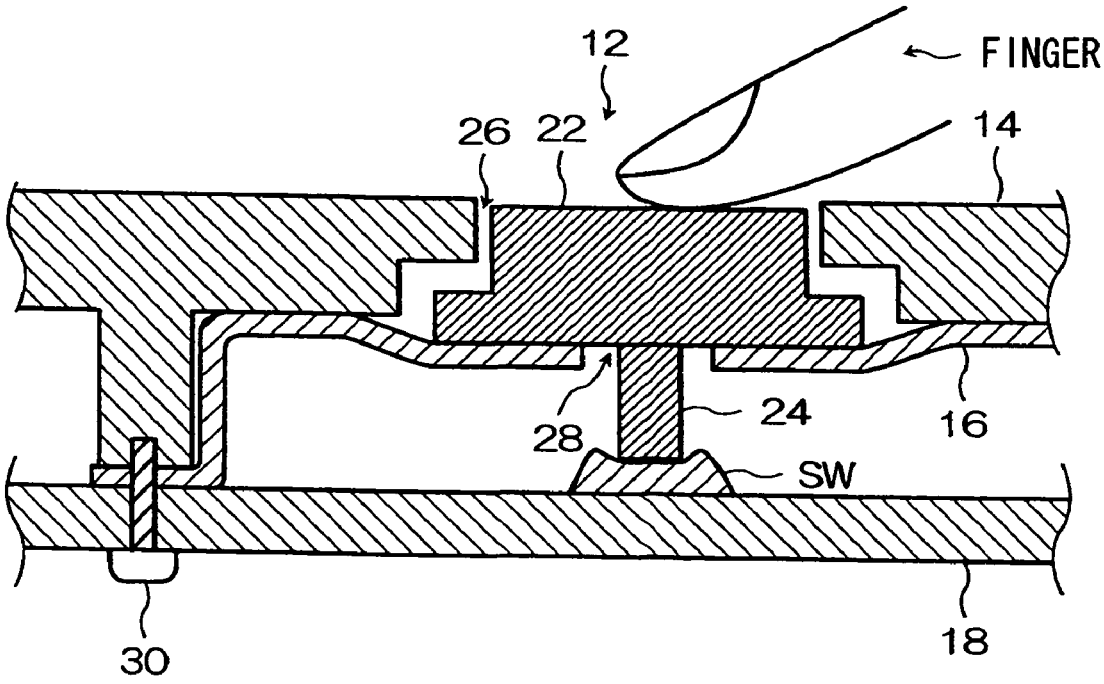
FIG. 3 is a sectional view schematically showing an operating method of the operating member 10.

FIG. 3 is a sectional view schematically showing an operating method of the operating member 10. When the key top 22 of the button member 12 is pressed by the finger of a user as shown in FIG. 3, the sheet member 16 is bent and the button member 12 is pressed down. Then, the switch SW on the base board 18 is pressed by the key stem 24, and a contact point not shown in the switch SW is brought into electrical conduction to perform switching. When the finger of the user is released from the key top 22, the button member 12 is pushed up to the position in FIG. 2 by the elasticity of the sheet member 16. Thereby, electric conduction of the contact point in the switch SW is ceased.

According to the first embodiment, the button member 12 is held by the thin sheet member 16, and therefore, the components which construct the operating member 10 can be downsized and slimmed. Surface treatment (for example, plating, coating, polishing, vapor deposition, ion plating, embossing) can be easily applied individually to the key tops 22 of the button members 12 before assembly of the operating member 10, and therefore, discrimination of the button members 12 can be facilitated.

Figure 4:
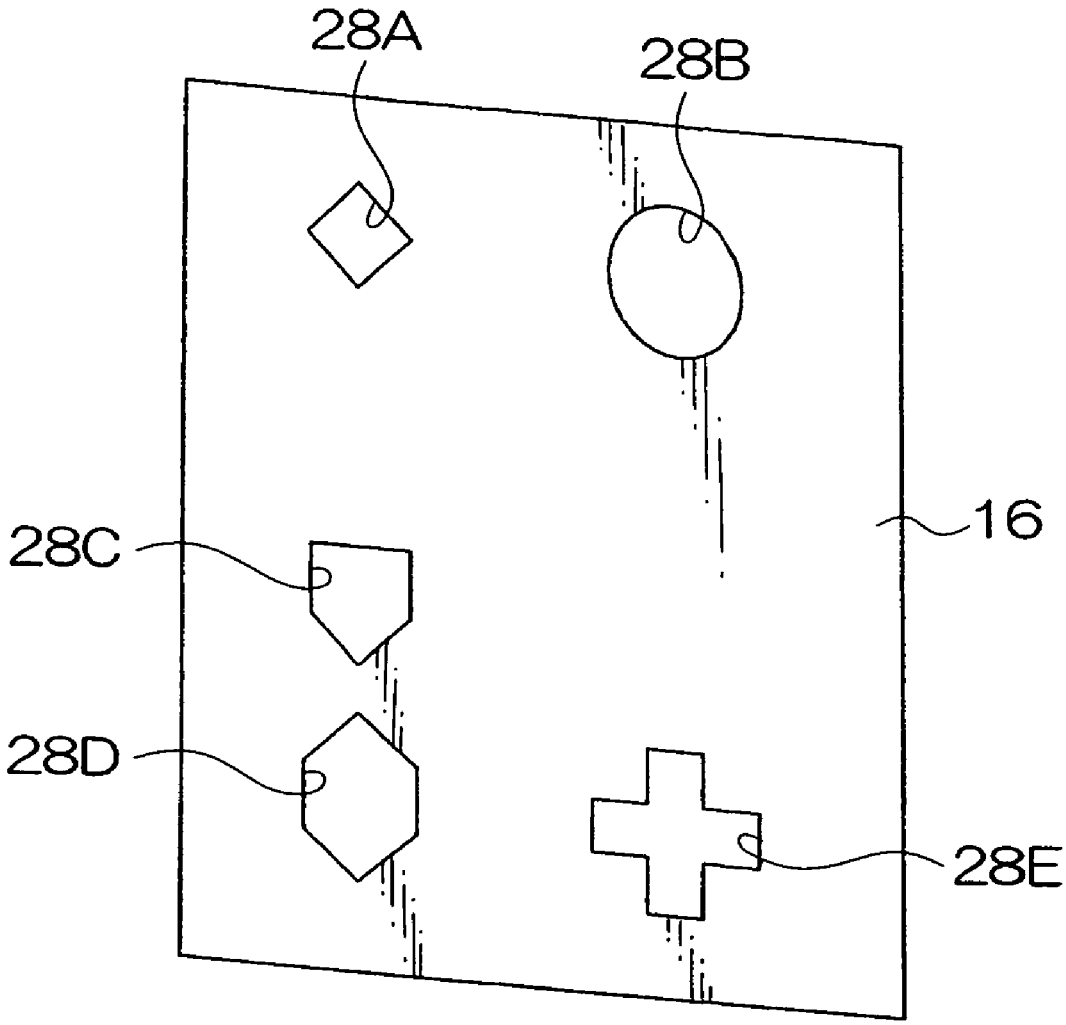
FIG. 4 is a plane view showing an example of a shape of a key stem opening.
Figure 5A:
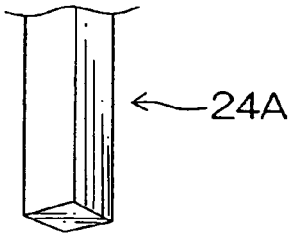
FIGS. 5A to 5E are perspective views showing an example of a shape of the key stem.
Figure 5D:
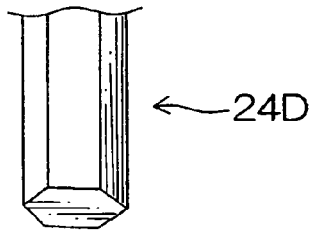
Figure 5B:
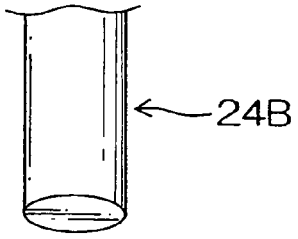
Figure 5E:
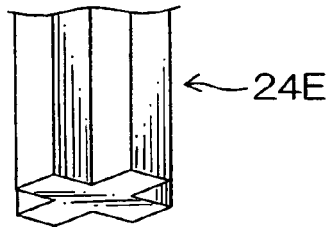
Figure 5C:
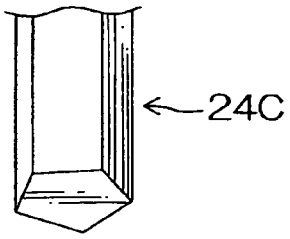

Next, the shapes of the key stems 24 and the key stem openings 28 will be described with reference to FIGS. 4 and 5. FIG. 4 is a plane view showing examples of the shapes of the key stem openings. As shown in FIG. 4, the sheet member 16 of the first embodiment is provided with five key stem openings 28A to 28E, and their shapes differ from each other.

FIGS. 5A to 5E are perspective views showing the examples of the shapes of the key stems. The key stems 24A to 24E shown in FIGS. 5A to 5E are respectively fitted into the key stem openings 28A to 28E shown in FIG. 4. As described above, by forming the key stems 24 and the key stem openings 28 into paired shapes respectively, the button members 12 can be prevented from being mistakenly disposed when the operating member 10 is assembled.

Figure 6:
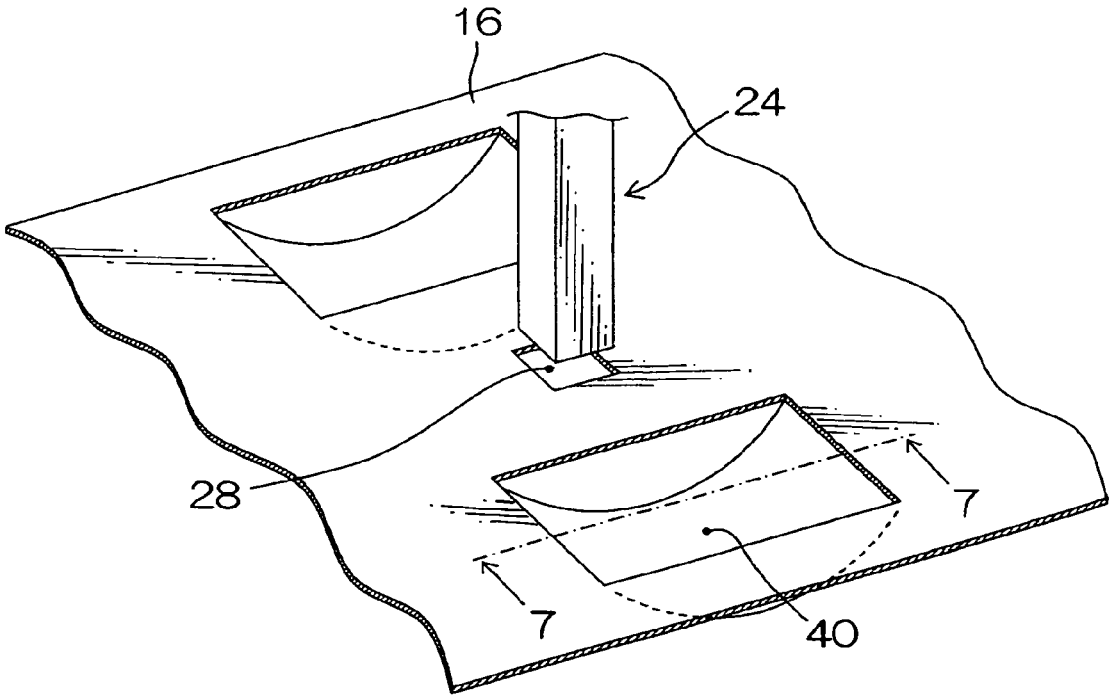
FIG. 6 is a perspective view showing a support structure of a sheet member 16.
Figure 7:
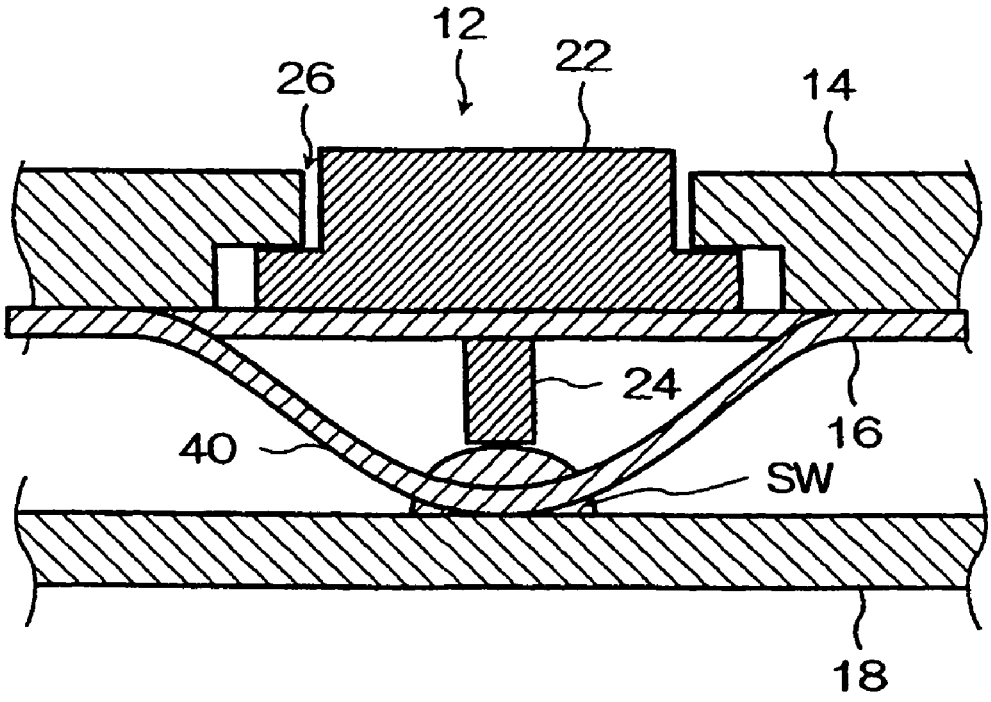
FIG. 7 is a sectional view taken along the line 7 to 7 in FIG. 6.

Next, a support structure of the sheet member 16 will be described with reference to FIGS. 6 and 7. FIG. 6 is a perspective view showing the support structure of the sheet member 16, and FIG. 7 is a sectional view taken along the line 7 to 7 in FIG. 6. As shown in FIG. 6, cutting is performed for a part of the sheet member 16, and the part of the sheet member 16 is worked to have the structure bent to the base board 18 side. A bent portion 40 is biased (pressed) to the apparatus casing 14 side by the base board 18. Thereby, the sheet member 16 can be prevented from sagging and separating from the apparatus casing 14 to bring the button member 12 into contact with the switch SW to cause malfunction of the apparatus.

In the first embodiment, the sheet member 16 is supported by applying cutting to a part of the sheet member 16, but the sheet member 16 may be biased by sticking a plate spring to the sheet member 16, or mounting a spring between the sheet member 16 and the base board 18, for example.

The sheet member 16 has metal particles of iron, silver, copper lead or the like mixed therein and has electrical conductivity. Thereby, static electricity which occurs by a pressing operation for the button member 12 of the like is discharged to an outside via the apparatus casing 14.

In the first embodiment, a layer in which the metal particles are mixed, or a layer of wiring or the like having elasticity may be provided on the surface of the sheet member 16. The sheet member 16 may be electrically connected to a ground (GND) of the circuit on the base board 18.

Figure 8:
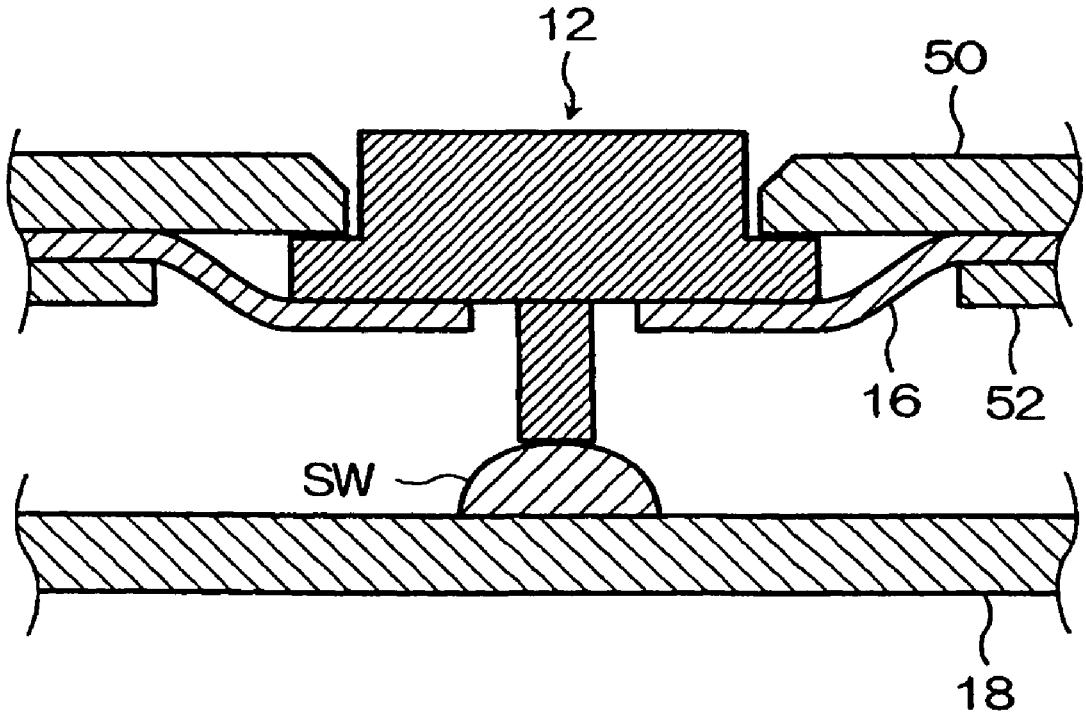
FIG. 8 is a sectional view showing another embodiment of a fixing method of the sheet member 16.

Next, another embodiment of a method for fixing the sheet member 16 to the apparatus casing 14 will be described. FIG. 8 is a sectional view showing a second embodiment of the method for fixing the sheet member 16. In the following explanation, the same constructions as the above described first embodiment such as the button members 12 and the like are given the same reference numerals and characters and the explanation of them will be omitted. In the example shown in FIG. 8, the surface on which the operating member 10 of the apparatus is placed has the structure in which an outer member 50 and an inner cabinet 52 are overlaid on each other, and the sheet member 16 is fixed by being sandwiched between the outer member 50 and the inner cabinet 52. The base board 18 is fixed to the inner cabinet 52 with a screw or the like not shown.

According to the second embodiment, the sheet member 16 can be reliably held by being sandwiched between the outer member 50 and the inner cabinet 52, and therefore, the button member 12 can be more reliably mounted.

Figure 9:
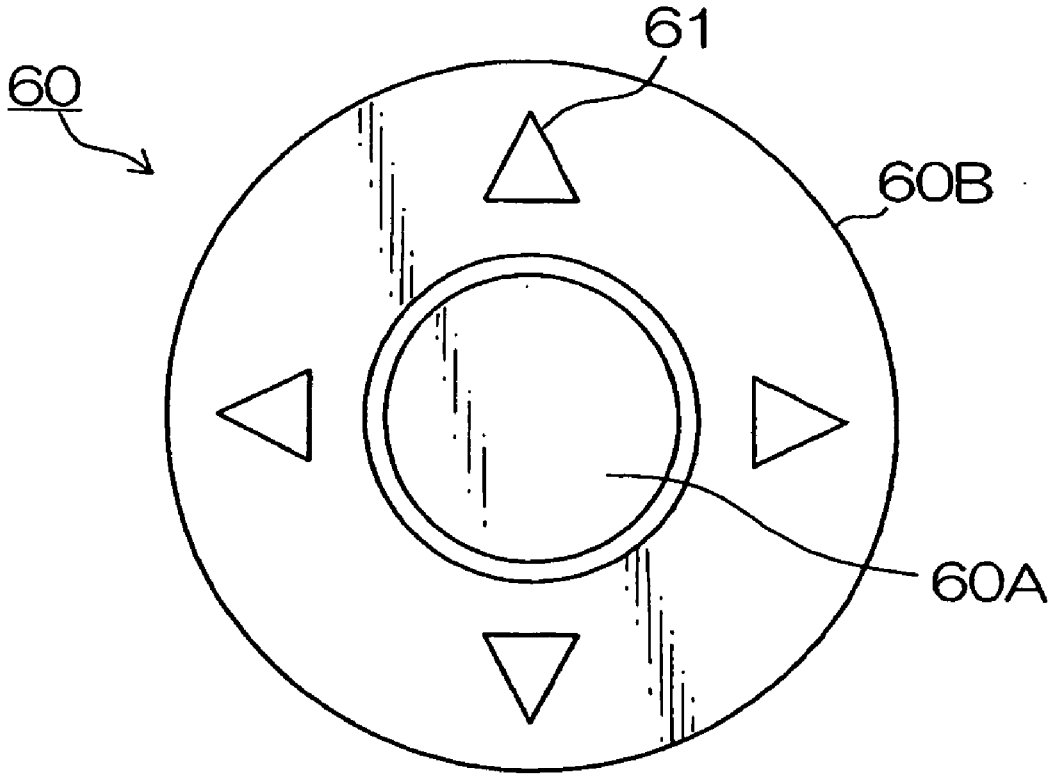
FIG. 9 is a plane view showing a cross button.

Next, an example in which the operating member of the present invention is applied to a cross button will be described with reference to FIGS. 9 to 12. FIG. 9 is a plane view showing the cross button, FIG. 10 is a plane view showing a key stem opening for the cross button, and FIG. 11 is a sectional view of the cross button.

A cross button 60 shown in FIG. 9 is constructed by a center button 60A and a cursor button 60B. The cursor button 60B is a multi-functional operating part capable of inputting instructions of four directions, that are left, right, up and down, and functions as an operation button which instructs selection of menu items. The center button 60A is used at the time of entering the content selected by the cursor button 60B, instructing execution (ensuring) of the processing and the like. Four key stems are formed at the cursor button 60B corresponding to the direction marks 61 which show input directions.

Figure 10:
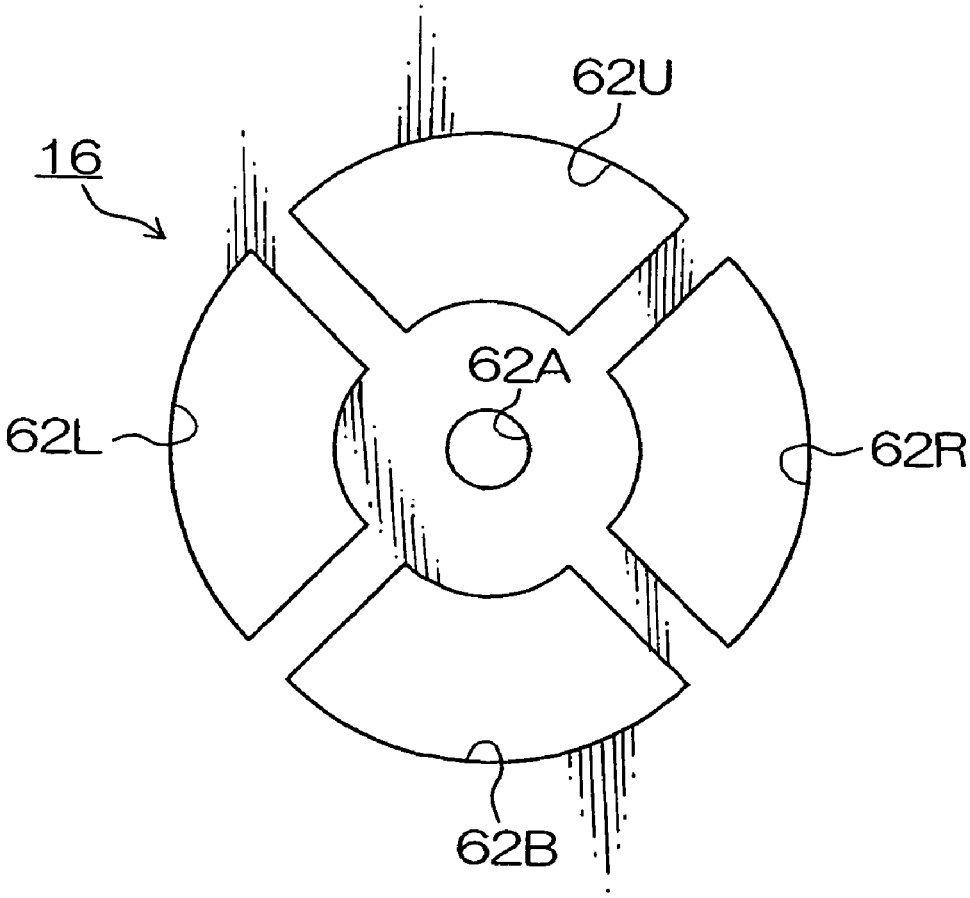
FIG. 10 is a plane view showing a key stem opening for the cross button.
Figure 11:
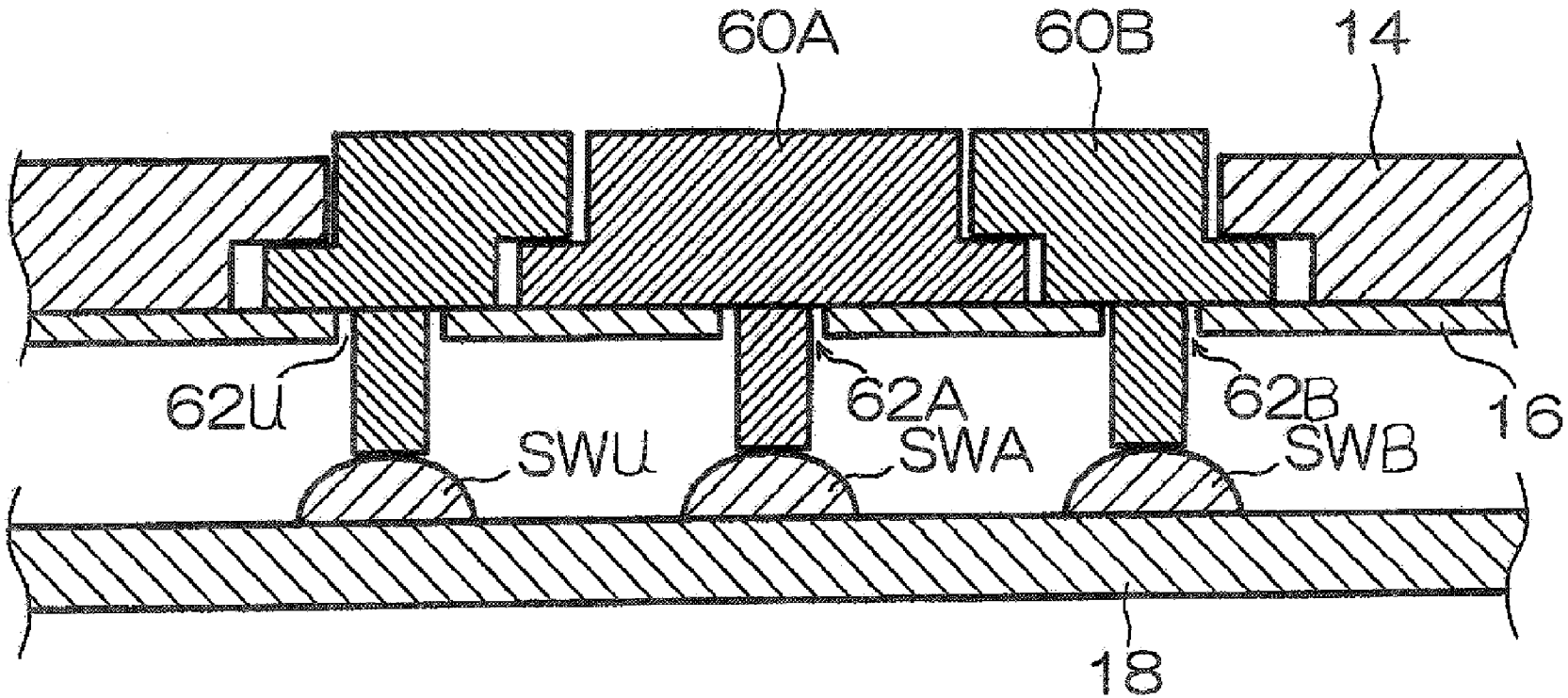
FIG. 11 is a sectional view of the cross button.

As shown in FIG. 10, a key stem opening 62A in which a key stem of the center button 60A is fitted, and key stem openings 62U, 62B, 62L and 62R in which the four key stems of the cursor button 60B are fitted are formed in the sheet member 16. As shown in FIG. 11, switches SWU, SWB, SWL and SWR are placed on the base board 18 corresponding to the key stem openings 62U, 62B, 62L and 62R. When the center button 60A is pressed by a user, the center button 60A is pushed down, and the switch SWA is pressured. When each portion of the cursor button 60B is pressed, the pressed portion is pushed down and the switch SWU, SWB, SWL or SWR is pressed. Thereby, the components of the cross button 60 can be downsized and slimmed.

Figure 12:
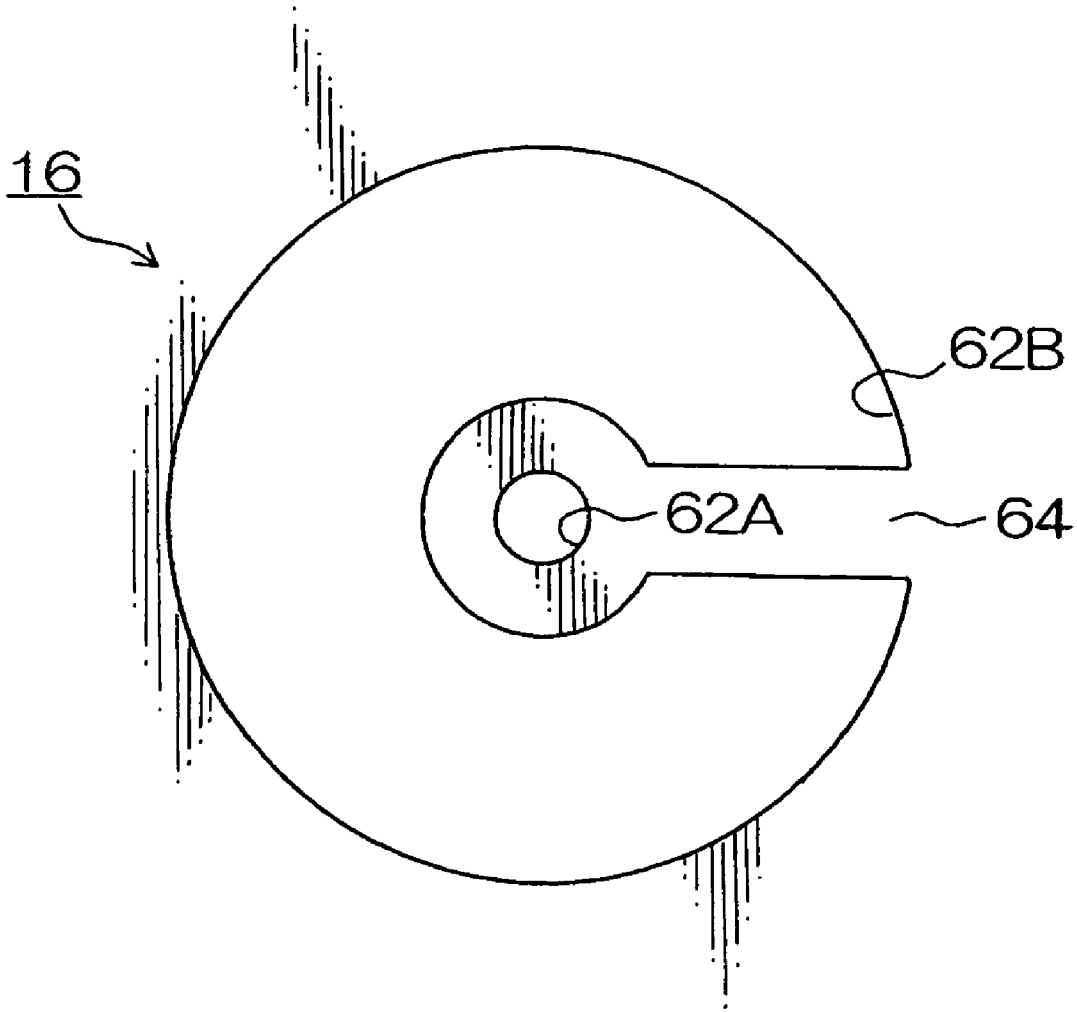
FIG. 12 is a plane view showing another embodiment of a shape of the key stem opening for the cross button.

FIG. 12 is a plane view showing another example of the shape of the key stem opening for the cross button. In the example shown in FIG. 12, a key stem opening 62B for the cursor button 60B is formed into a C-shape, and a region in a center where the key stem opening 62A is formed is supported by a support portion 64.

In the cross button 60, the mode in which the sheet member 16 is given electrical conductivity and is caused to discharge static electricity, and the structure in which the casing of the apparatus is outer member and the inner cabinet which are overlaid on each other as in the example in FIG. 8 can be applied.

What is claimed is:

1. An operating member comprising:

a button member having a key top and a key stem;

an apparatus casing having a button opening from which the key top is exposed;

a sheet member which is formed of a material having elasticity, has a key stem opening through which the key stem is penetrated, and holds the button member by pressing the button member to the button opening;

a base board on which a switch, which constructs a transmission path of a signal when the key top is pressed and the switch is pressed by the key stem, is placed; and a sheet support member which presses the sheet member against the apparatus casing, wherein the sheet support member is a bent part which is bent toward a side of the base board on which the switch is placed by cutting a part of the sheet member, and wherein the bent part is biased toward the apparatus casing side by the base board.

2. The operating member according to claim 1, wherein the sheet member is formed of any one of polyester, polycarbonate and vinyl chloride.

3. The operating member according to claim 2, wherein at least one of coating, plating, polishing, vapor deposition, ion plating and embossing is applied to a surface of the key top of the button member.

4. The operating member according to claim 3, wherein shapes of the key stem and the key stem opening are paired.

5. The operating member according to claim 4, wherein the sheet member has electrical conductivity, and when the sheet member is charged with static electricity, the sheet member discharges the static electricity to an outside.

6. The operating member according to claim 1, wherein at least one of coating, plating, polishing, vapor deposition, ion plating and embossing is applied to a surface of the key top of the button member.

7. The operating member according to claim 1, wherein shapes of the key stem and the key stem opening are paired.

8. The operating member according to claim 1, wherein the sheet member has electrical conductivity, and when the sheet member is charged with static electricity, the sheet member discharges the static electricity to an outside.

9. An operating member, comprising:

a button member having a key top and a key stem;

an apparatus casing having a button opening from which the key top is exposed;

a sheet member which is formed of a material having elasticity, has a key stem opening through which the key stem is penetrated, and holds the button member by pressing the button member to the button opening; and a base board on which a switch which constructs a transmission path of a signal when the key top is pressed and the switch is pressed by the key stem is placed, wherein shapes of the key stem and the key stem opening are paired.

* * * * *